US009184016B2

(12) United States Patent
Liu et al.

(10) Patent No.: US 9,184,016 B2
(45) Date of Patent: Nov. 10, 2015

(54) FIELD EMISSION CATHODE DEVICE AND FIELD EMISSION EQUIPMENT USING THE SAME

(71) Applicants: Tsinghua University, Beijing (CN); HON HAI PRECISION INDUSTRY CO., LTD., New Taipei (TW)

(72) Inventors: Peng Liu, Beijing (CN); Chun-Hai Zhang, Beijing (CN); Duan-Liang Zhou, Beijing (CN); Bing-Chu Du, Beijing (CN); Cai-Lin Guo, Beijing (CN); Pi-Jin Chen, Beijing (CN); Shou-Shan Fan, Beijing (CN)

(73) Assignees: Tsinghua University, Beijing (CN); HON HAI PRECISION INDUSTRY CO., LTD., New Taipei (TW)

( * ) Notice: Subject to any disclaimer, the term of this patent is extended or adjusted under 35 U.S.C. 154(b) by 94 days.

(21) Appl. No.: 13/868,242

(22) Filed: Apr. 23, 2013

(65) Prior Publication Data

US 2014/0159566 A1 Jun. 12, 2014

(30) Foreign Application Priority Data

Dec. 6, 2012 (CN) ..... 2012 1 05181362

(51) Int. Cl.
*H01J 1/304* (2006.01)
*H01J 3/02* (2006.01)
*H01J 31/12* (2006.01)

(52) U.S. Cl.
CPC ..... *H01J 1/304* (2013.01); *H01J 3/021* (2013.01); *H01J 31/127* (2013.01); *H01J 2203/0236* (2013.01)

(58) Field of Classification Search
CPC ..... H01J 1/304
USPC ..... 313/346, 495–497
See application file for complete search history.

(56) References Cited

U.S. PATENT DOCUMENTS

| | | | | |
|---|---|---|---|---|
| 5,229,331 | A * | 7/1993 | Doan et al. | 438/20 |
| 5,903,092 | A * | 5/1999 | Akama | 313/311 |
| 6,062,931 | A * | 5/2000 | Chuang et al. | 445/24 |
| 6,064,149 | A * | 5/2000 | Raina | 313/497 |
| 6,084,245 | A * | 7/2000 | Hsu et al. | 257/10 |
| 6,097,138 | A * | 8/2000 | Nakamoto | 313/309 |
| 6,339,281 | B2 * | 1/2002 | Lee et al. | 313/309 |
| 6,440,763 | B1 * | 8/2002 | Hsu | 438/20 |
| 6,445,123 | B1 * | 9/2002 | Tjaden et al. | 313/495 |
| 6,448,701 | B1 * | 9/2002 | Hsu | 313/309 |
| 6,632,114 | B2 * | 10/2003 | Choi et al. | 445/24 |
| 6,642,639 | B2 * | 11/2003 | Choi et al. | 313/309 |
| 6,809,464 | B2 * | 10/2004 | Choi et al. | 313/309 |
| 6,812,635 | B2 * | 11/2004 | Cho et al. | 313/495 |

(Continued)

FOREIGN PATENT DOCUMENTS

TW 201142895 12/2011

*Primary Examiner* — Thomas A Hollweg
(74) *Attorney, Agent, or Firm* — Novak Druce Connolly Bove + Quigg LLP

(57) ABSTRACT

A field emission cathode device includes a cathode electrode. An electron emitter is electrically connected to the cathode electrode, wherein the electron emitter includes a number of sub-electron emitters. An electron extracting electrode is spaced from the cathode electrode by a dielectric layer, wherein the electron extracting electrode defines a through-hole. The distances between an end of each of the sub-electron emitters away from the cathode electrode and a sidewall of the through-hole are substantially equal.

18 Claims, 12 Drawing Sheets

(56) References Cited

U.S. PATENT DOCUMENTS

| | | | | |
|---|---|---|---|---|
| 6,911,767 | B2 * | 6/2005 | Takai | 313/311 |
| 6,927,534 | B2 * | 8/2005 | Choi et al. | 313/495 |
| 6,976,897 | B2 * | 12/2005 | Choi et al. | 445/24 |
| 7,279,085 | B2 * | 10/2007 | Hudspeth et al. | 205/118 |
| 7,652,418 | B2 * | 1/2010 | Choi et al. | 313/497 |
| 8,229,074 | B2 * | 7/2012 | Mahapatra | 378/122 |
| 8,237,347 | B2 | 8/2012 | Liu et al. | |
| 2007/0029918 | A1 * | 2/2007 | Raina et al. | 313/495 |
| 2008/0018228 | A1 * | 1/2008 | Choi et al. | 313/497 |
| 2008/0164798 | A1 * | 7/2008 | Baik et al. | 313/103 R |
| 2009/0115306 | A1 * | 5/2009 | Wei et al. | 313/309 |
| 2009/0134766 | A1 * | 5/2009 | Kim et al. | 313/309 |
| 2009/0322200 | A1 * | 12/2009 | Kolake et al. | 313/483 |
| 2010/0045158 | A1 * | 2/2010 | Kim et al. | 313/313 |
| 2010/0328582 | A1 * | 12/2010 | Yoo et al. | 349/69 |
| 2011/0005191 | A1 * | 1/2011 | Ready et al. | 60/202 |
| 2011/0038465 | A1 * | 2/2011 | Mahapatra | 378/143 |

* cited by examiner

FIELD EMISSION CATHODE DEVICE AND FIELD EMISSION EQUIPMENT USING THE SAME

RELATED APPLICATIONS

This application claims all benefits accruing under 35 U.S.C. §119 from China Patent Application No. 201210518136.2, filed on Dec. 6, 2012 in the China Intellectual Property Office, the disclosure of which is incorporated herein by reference.

BACKGROUND

1. Technical Field

The present application relates to a field emission cathode device and field emission equipment using the field emission cathode device.

2. Discussion of Related Art

Conventional field emission cathode device includes an insulating substrate, a cathode electrode fixed on the insulating substrate, a plurality of electron emitters fixed on the cathode electrode, a dielectric layer fixed on the insulating substrate, and a gate electrode fixed on the dielectric layer. The gate electrode provides an electrical potential to extract electrons from the plurality of electron emitters. When a field emission display using the field emission cathode device is operated, an anode electrode provides an electrical potential to accelerate the extracted electrons to bombard the anode electrode for luminance.

However, the electron emitters such as carbon nanotubes, carbon nanofibres, or silicon nanowires have equal length. The electron emitters close to the gate electrode have large field strength, and the electron emitters away from the gate electrode have very small field strength. Therefore, the electron emitters close to the gate electrode can emit more electrons, the electron emitters away from the gate electrode can emit very few electron, which affects the emission current of the electron emitters.

What is needed, therefore, is to provide a field emission cathode device and field emission equipment using the field emission cathode device to overcome the afore mentioned shortcomings.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
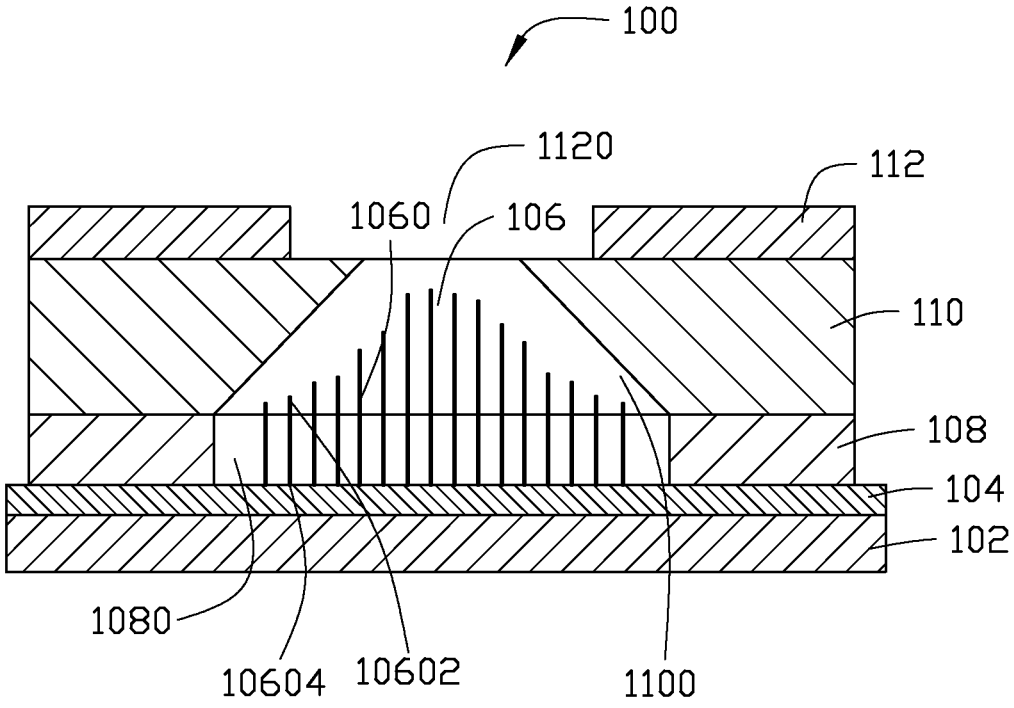
FIG. 1 is a schematic view of one embodiment of a field emission cathode device.
Figure 2:
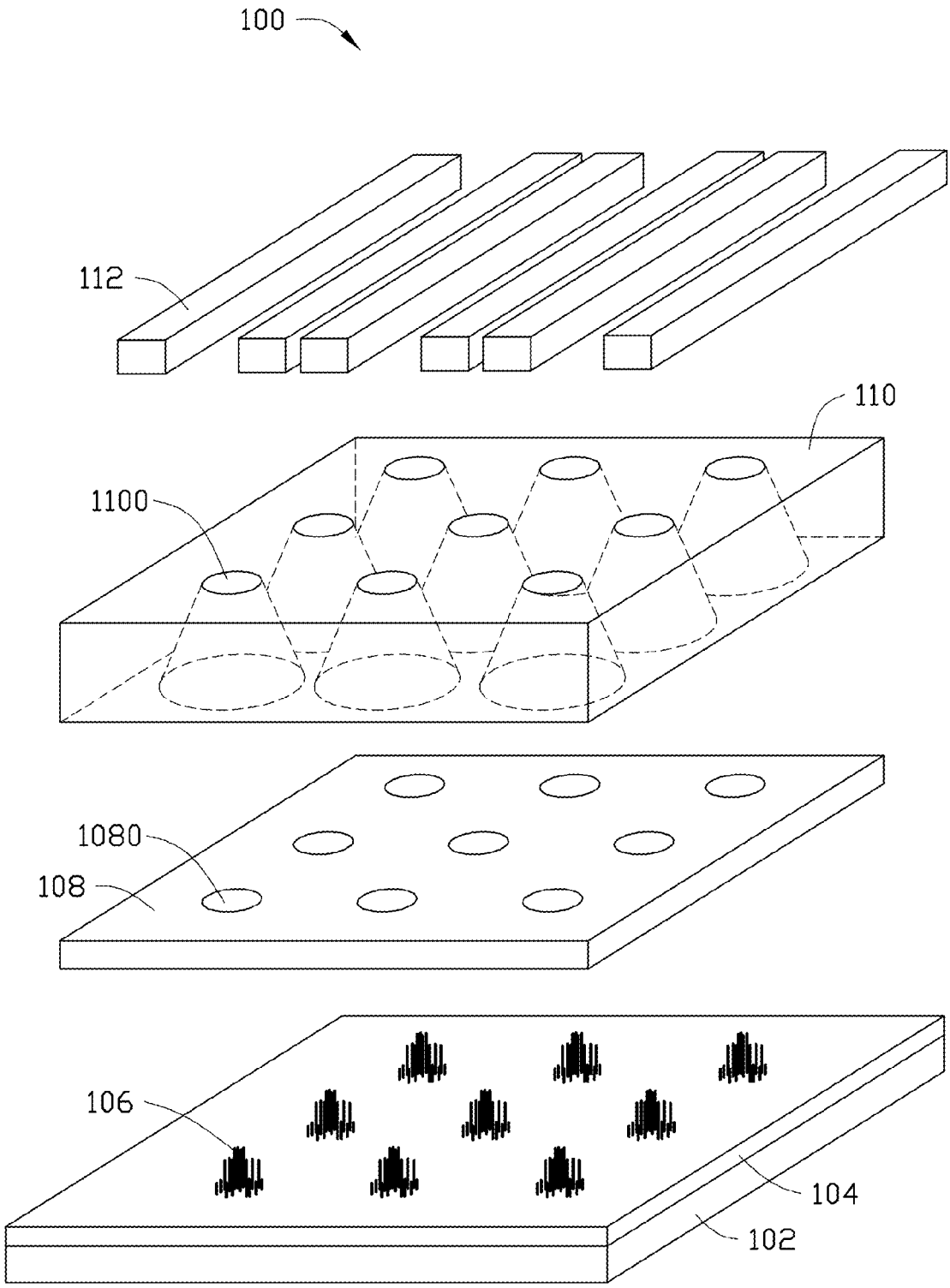
FIG. 2 is a three-dimensional exploded schematic view of one embodiment of the field emission cathode device array.

Referring to FIGS. 1 and 2, a field emission cathode device 100 of one embodiment includes an insulating substrate 102, a cathode electrode 104, an electron emitter 106, a dielectric layer 108, and an electron extracting electrode 110.

The cathode electrode 104 is located on a surface of the insulating substrate 102. The dielectric layer 108 is located on a surface of the cathode electrode 104. The dielectric layer 108 defines a first opening 1080, such that a part of the cathode electrode 104 is exposed. The electron emitter 106 is located on a surface of the cathode electrode 104 and electrically connected to the cathode electrode 104, wherein the surface is exposed through the first opening 1080.

The electron extracting electrode 110 is located on a surface of the dielectric layer 108. The electron extracting electrode 110 is spaced from the cathode electrode 104 by the dielectric layer 108. The electron extracting electrode 110 defines a through-hole 1100, exposing the electron emitter 106. In one embodiment, the through-hole 1100 of the electron extracting electrode 110 is upside of the electron emitter 106. The field emission cathode device 100 further includes a fixing element 112 located on a surface of the electron extracting electrode 110. The fixing element 112 is used to fix the electron extracting electrode 110 on the dielectric layer 108.

The dielectric layer 108 can be directly located on the cathode electrode 104 or directly located on the insulating substrate 102. The dielectric layer 108 is located between the cathode electrode 104 and the electron extracting electrode 110, such that there is insulation between the cathode electrode 104 and the electron extracting electrode 110. The dielectric layer 108 can be a layer structure having the first opening 1080. The dielectric layer 108 can be a plurality of strip-shaped structures spaced from each other. A gap between two adjacent strip-shaped structures is the first opening 1080.

A material of the insulating substrate 102 can be ceramics, glass, resins, quartz, or polymer. The size, shape, and thickness of the insulating substrate 102 can be chosen according to need. The insulating substrate 102 can be a square plate, a round plate, or a rectangular plate. In one embodiment, the insulating substrate 102 is a square glass plate, wherein the length of side of the square glass plate is about 10 millimeters, the thickness of the square glass plate is about 1 millimeter.

The cathode electrode 104 can be a conductive layer or a conductive plate. The size, shape, and thickness of the cathode electrode 104 can be chosen according to need. The cathode electrode 104 can be made of metal, alloy, conductive slurry, or indium tin oxide (ITO). In one embodiment, the cathode electrode 104 is an aluminum layer with a thickness of about 1 micrometer.

The dielectric layer 108 can be made of resin, glass, ceramic, oxide, photosensitive emulsion, or combination thereof. The oxide can be silicon dioxide, aluminum oxide, or bismuth oxide. The size and shape of the dielectric layer 108 can be chosen according to need. In one embodiment, the dielectric layer 108 is a ring-shaped SU-8 photosensitive emulsion with a thickness of about 100 micrometers. In one embodiment, the first opening 1080 is coaxial with the through-hole 1100.

The electron extracting electrode 110 can be a layer electrode defining the through-hole 1100 or a plurality of strip-shaped electrodes. There is a distance between two adjacent strip-shaped electrodes. The electron emitter 106 is exposed through the through-hole 1100 or the distance between two adjacent strip-shaped electrodes. The electron extracting electrode 110 can be made of metal, alloy, conductive slurry, carbon nanotube, or ITO. The metal can be copper, aluminum, gold, silver, or iron. A thickness of the electron extracting electrode 110 can be greater than or equal to 10 micrometers. In one embodiment, the thickness of the electron extracting electrode 110 is in a range from about 30 micrometers to about 60 micrometers.

The through-hole 1100 of the electron extracting electrode 110 is shaped as an inverted funnel such that the width thereof is narrowed as it goes apart from the insulating substrate 102 or the cathode electrode 104. The width of the through-hole 1100 close to the cathode electrode 104 can be in a range from about 80 micrometers to about 1 millimeter. The width of the through-hole 1100 away from the cathode electrode 104 can be in a range from about 10 micrometers to about 1 millimeter. A secondary electron emission layer can be formed on the sidewall of the through-hole 1100 of the electron extracting electrode 110. When the electrons emitted from the electron emitter 106 pass the dielectric layer 108 and collide against the sidewall of the through-hole 1100, the secondary electron emission layer emits secondary electrons, thereby increasing the amount of electrons. The secondary electron emission layer can be formed with an oxide, such as magnesium oxide.

A height of the electron emitter 106 gradually reduces from a center of the electron emitter 106 out. The thickness and the size of the electron emitter 106 can be chosen according to need. The shape of the electron emitter 106 is consistent with the shape of the sidewall of the through-hole 1100.

The electron emitter 106 includes a plurality of sub-electron emitters 1060, such as carbon nanotubes, carbon nanofibres, or silicon nanowires. Each sub-electron emitter 1060 has an emission end 10602 and a terminal end 10604 opposite to the emission end 10602. The terminal end 10604 of each sub-electron emitter 1060 electrically connects to the cathode electrode 104. In one embodiment, the emission end 10602 of each sub-electron emitter 1060 is in the through-hole 1100 of the electron extracting electrode 110. That is, the height of each sub-electron emitter 1060 is greater than the thickness of the dielectric layer 108. A connecting line of the emission end 10602 of each sub-electron emitter 1060 is consistent with the shape of the sidewall of the through-hole 1100.

A shortest distance between the emission end 10602 of each sub-electron emitter 1060 and the sidewall of the through-hole 1100 is substantially equal. The shortest distances between the emission end 10602 of each sub-electron emitter 1060 and the sidewall of the through-hole 1100 can be in a range from about 5 micrometers to about 300 micrometers. A difference between the shortest distances between the emission end 10602 of each sub-electron emitter 1060 and the sidewall of the through-hole 1100 can be in a range from about 0 micrometers to about 100 micrometers. In one embodiment, the shortest distances between the emission end 10602 of each sub-electron emitter 1060 and the sidewall of the through-hole 1100 are equal, and each sub-electron emitter 1060 is substantially perpendicular to the cathode electrode 104. In one embodiment, the shortest perpendicular distances between the emission end 10602 of each sub-electron emitter 1060 and the sidewall of the through-hole 1100 are equal, and each sub-electron emitter 1060 is substantially perpendicular to the cathode electrode 104. The shortest perpendicular distances between the emission end 10602 of each sub-electron emitter 1060 and the sidewall of the through-hole 1100 are in a range from about 5 micrometers to about 250 micrometers.

Furthermore, the electron emitter 106 can be coated with a protective layer (not shown) to improve stability and lifespan of the electron emitter 106. The protective layer can be made of anti-ion bombardment materials such as zirconium carbide, hafnium carbide, and lanthanum hexaborid. The protective layer can be coated on a surface of each sub-electron emitter 1060.

Figure 3:
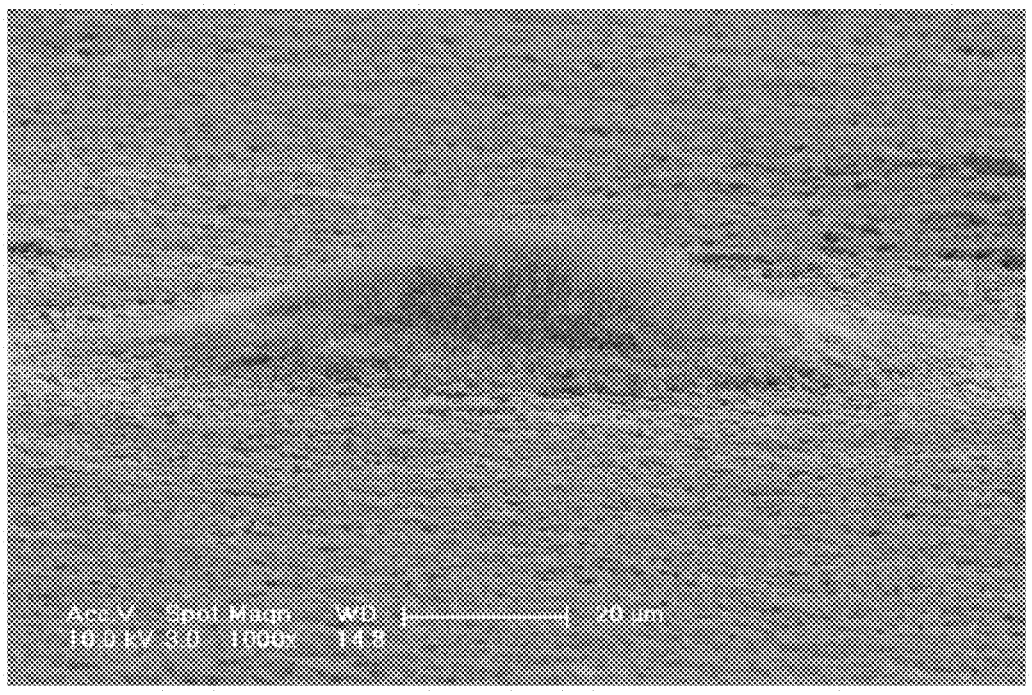
FIG. 3 is scanning electron microscope (SEM) image of a carbon nanotube array.

In one embodiment, the electron emitter 106 is a carbon nanotube array having a hill-like shape, as shown in FIG. 3. The carbon nanotube array includes a plurality of carbon nanotubes parallel to each other. Each of the plurality of carbon nanotubes extends to the through-hole 1100 of the electron extracting electrode 110. A diameter of the hill is in the range from 50 micrometers to 80 micrometers. A maximum height of the hill is in the range from 10 micrometers to 20 micrometers. A diameter of each carbon nanotube is in the range from 40 nanometers to 80 nanometers.

The fixing element 112 can be made of insulating material. A thickness of the fixing element 112 can be chosen according to need. The shape of the fixing element 112 is the same as the shape of the dielectric layer 108. The fixing element 112 defines a second opening 1120 opposite to the first opening 1080, such that the electron emitter 106 is exposed through the second opening 1120. In one embodiment, the fixing element 116 is an insulating slurry layer.

Figure 4:
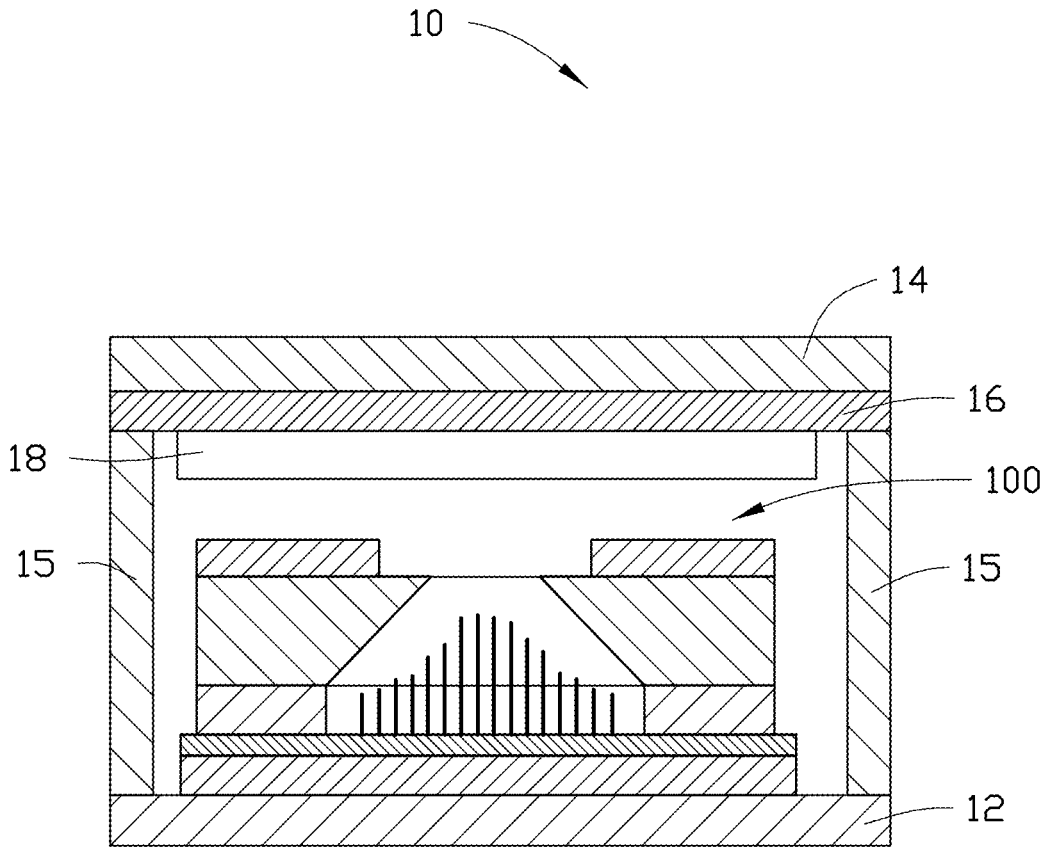
FIG. 4 is a schematic view of one embodiment of a pixel unit of a field emission display.

Referring to FIG. 4, a field emission display 10 of one embodiment includes a cathode substrate 12, an anode substrate 14, an anode electrode 16, a fluorescent layer 18, and the field emission cathode device 100.

The cathode substrate 12 and the anode substrate 14 are spaced from each other by an insulating supporter 15. The cathode substrate 12, the anode substrate 14, and the insulating supporter 15 form a vacuum space. The field emission cathode device 100, the anode electrode 16, and the fluorescent layer 18 are accommodated in the vacuum space. The anode electrode 16 is located on a surface of the anode substrate 14. The fluorescent layer 18 is located on a surface of the anode electrode 16. The field emission cathode device 100 is located on a surface of the cathode substrate 12. There is a distance between the fluorescent layer 18 and the field emission cathode device 100. In one embodiment, the cathode substrate 12 is the insulating substrate 102.

The cathode substrate 12 can be made of insulating material. The insulating material can be ceramics, glass, resins, quartz, or polymer. The anode substrate 14 is a transparent plate. The thickness, size and shape of the anode substrate 14 can be selected according to need. In one embodiment, the cathode substrate 12 and the anode substrate 14 are a glass plate. The anode electrode 16 is an ITO film with a thickness of about 100 micrometers. The fluorescent layer 18 can be round. The diameter of the fluorescent layer 18 can be greater than or equal to the inner diameter of the electron emitter 106 and less than or equal to the outer diameter of the electron emitter 106. In one embodiment, the fluorescent layer 18 is round and has a diameter approximately equal to the outer diameter of the electron emitter 106.

Figure 5:
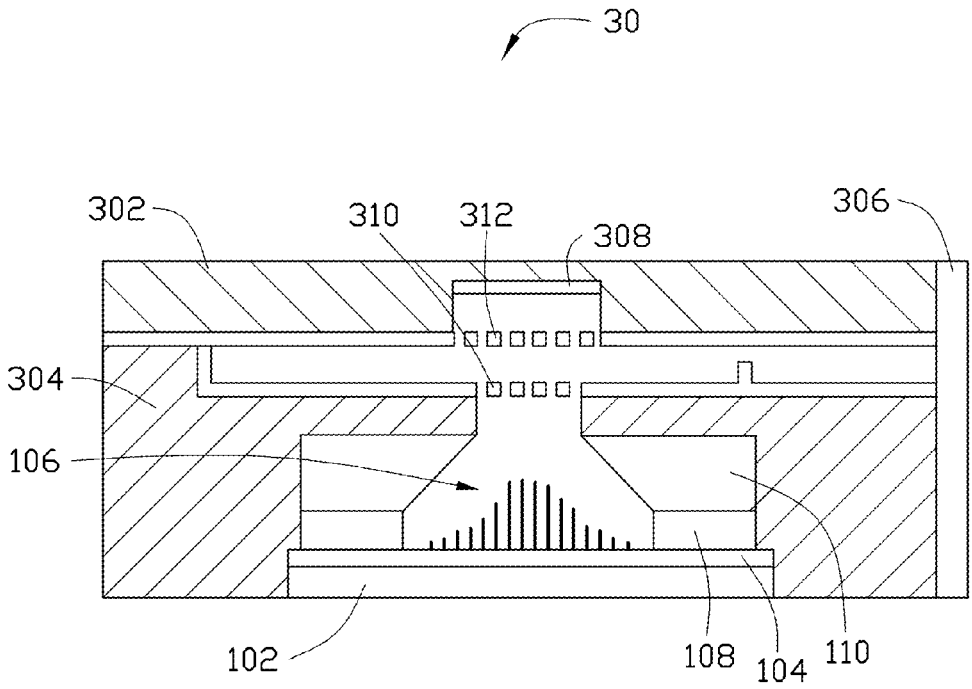
FIG. 5 is a schematic view of one embodiment of a THz electromagnetic tube.

Referring to FIG. 5, a THz electromagnetic tube 30 of one embodiment includes a first substrate 302, a second substrate 304, a lens 306, a first grid electrode 310, a second grid electrode 312, a reflecting layer 308, and the field emission cathode device 100.

The first substrate 302 and the second substrate 304 form a resonator. The lens 306 is located on one end of the resonator to form an output terminal. The field emission cathode device 100 is located on a surface of the second substrate 304 close to the first substrate 302. The first grid electrode 310 is located on narrowest of the through-hole 1100 of the electron extracting electrode 110. The first grid electrode 310 covers the through-hole 1100. The reflecting layer 308 is located on a surface of the first substrate 302 close to the second substrate 304 to reflect electrons. The reflecting layer 308 is opposite to the field emission cathode device 100. The second grid electrode 312 is suspended between the first grid electrode 310 and the reflecting layer 308. The electrons extracted from the electron emitter 106 of the field emission cathode device 100 are reflected by the reflecting layer 308 and oscillated in the resonator. The electrons are finally exported through the output terminal.

The first substrate 302 and the second substrate 304 can be made of metal, polymer or silicon. In one embodiment, the first substrate 302 and the second substrate 304 are made of silicon.

The first grid electrode 310 and the second grid electrode 312 can be a plane structure having a plurality of meshes. The shape of the plurality of meshes can be chosen according to need. An area of each of the plurality of meshes can be in a range from about 1 square micron to about 800 square microns, such as about 10 square microns, about 50 square microns, about 100 square microns, about 150 square microns, about 200 square microns, about 250 square microns, about 350 square microns, about 450 square microns, and about 600 square microns. The first grid electrode 310 and the second grid electrode 312 can be made of metal, alloy, conductive slurry, carbon nanotube, or ITO. The metal can be copper, aluminum, gold, silver, or iron. In one embodiment, the first grid electrode 310 and the second grid electrode 312 are made of at least two stacked carbon nanotube films. The carbon nanotube film includes a plurality of successive and oriented carbon nanotubes joined end-to-end by van der Waals attractive force therebetween. An angle between the aligned directions of the carbon nanotubes in two adjacent carbon nanotube films can be in a range from about 0 degrees to about 90 degrees. The area of each mesh of the first grid electrode 310 and the area of each mesh of the second grid electrode 312 are approximately equal, and the area of each mesh is in a range from about 10 micrometers to about 100 micrometers.

Figure 6:
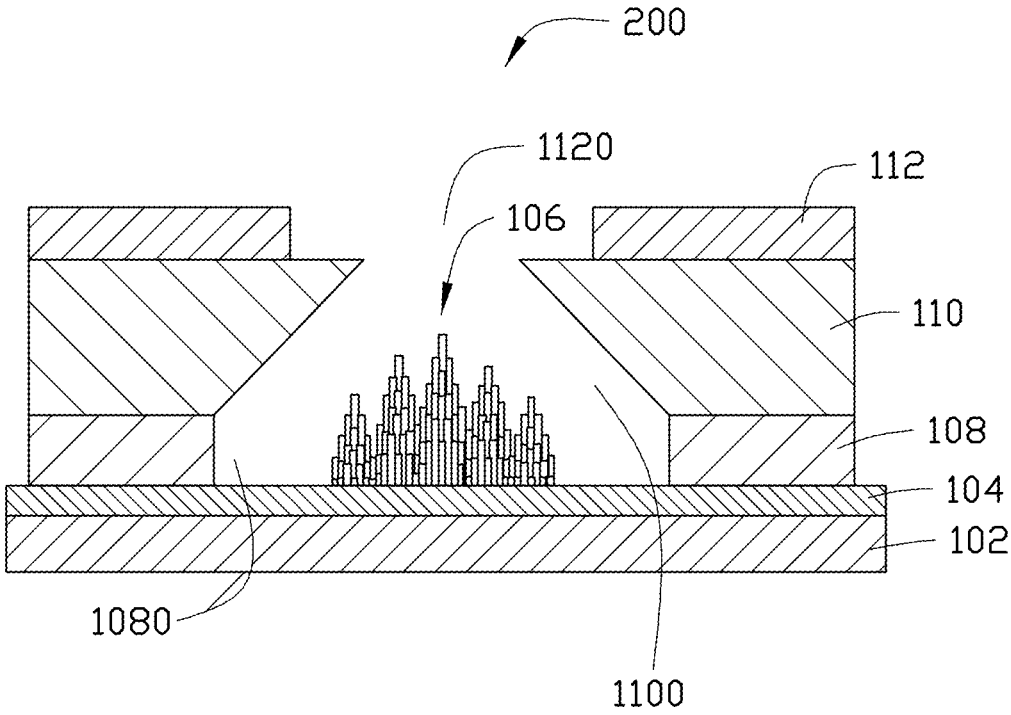
FIG. 6 is a schematic view of another embodiment of a field emission cathode device.

Referring to FIG. 6, an embodiment of a field emission cathode device 200 is shown where the electron emitter 106 is a carbon nanotube linear structure including a plurality of carbon nanotubes.

The carbon nanotube linear structure includes a plurality of carbon nanotube wires substantially parallel with each other or a plurality of carbon nanotube wires twisted with each other. That is, the carbon nanotube wire can be twisted or untwisted. The twisted carbon nanotube wire can be formed by twisting a drawn carbon nanotube film using a mechanical force to turn the two ends of the drawn carbon nanotube film in opposite directions. Each carbon nanotube wire includes a plurality of carbon nanotubes helically oriented around an axial direction of the carbon nanotube wire. Therefore, the carbon nanotube wire has a larger mechanical strength.

The untwisted carbon nanotube wire can be obtained by treating the drawn carbon nanotube film drawn from the carbon nanotube array with the volatile organic solvent. Each carbon nanotube wire includes a plurality of carbon nanotubes parallel to the axial direction of the carbon nanotube wire.

Figure 7:
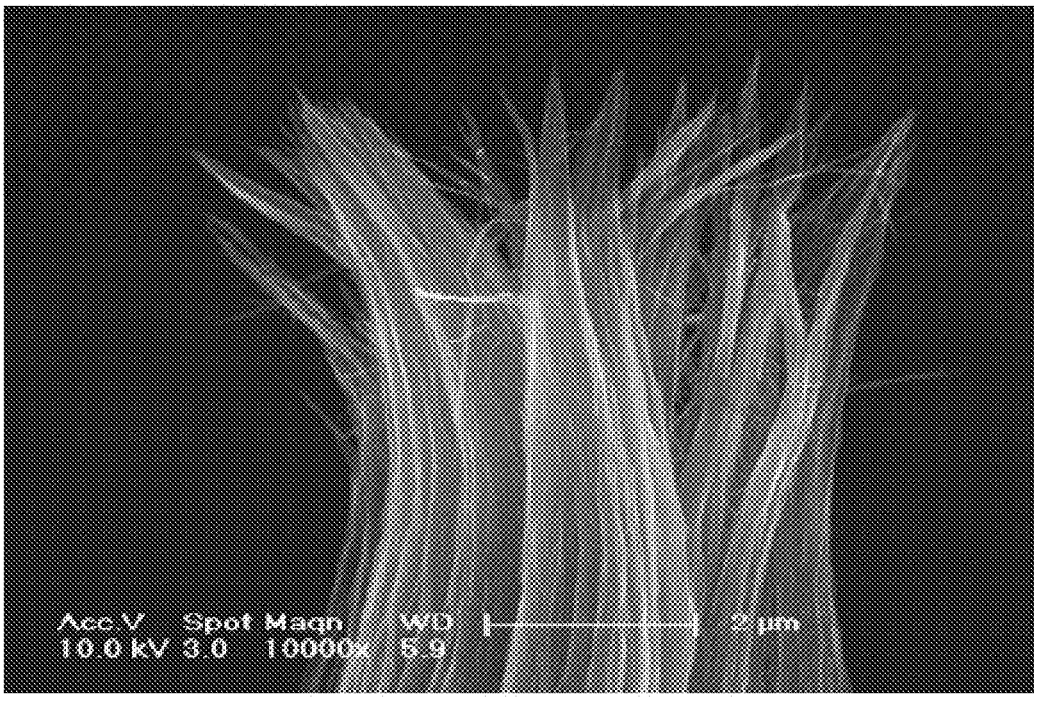
FIG. 7 is a SEM image of a carbon nanotube linear structure.
Figure 8:
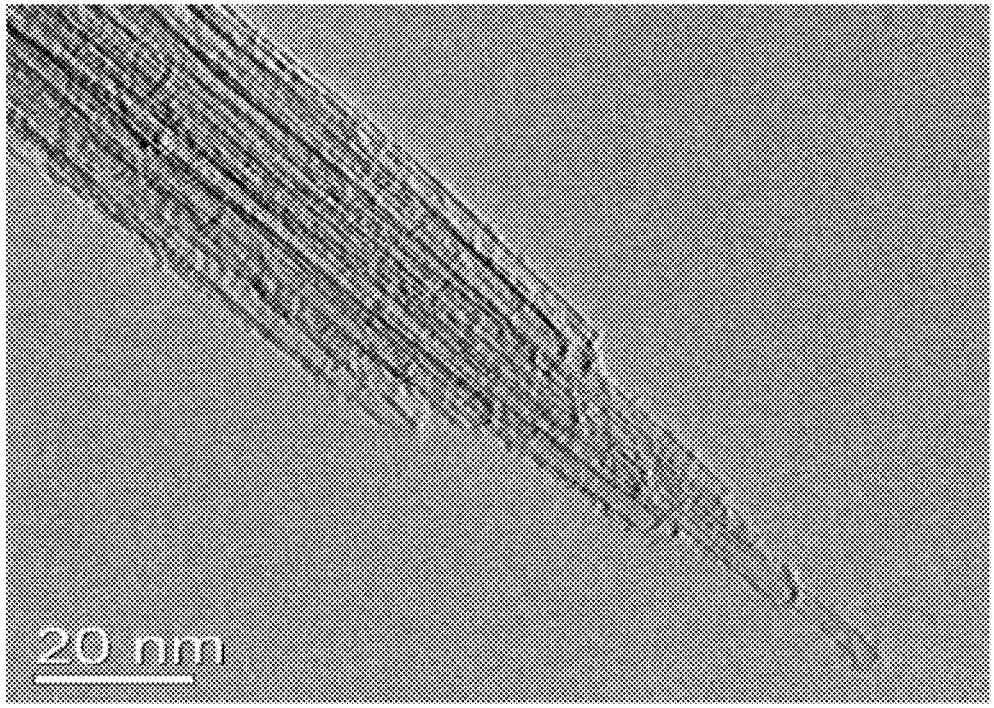
FIG. 8 is a transmission electron microscope (TEM) image of an end portion of the carbon nanotube linear structure of FIG. 7.

The carbon nanotube linear structure includes a first end and a second end opposite to the first end. The first end of the carbon nanotube linear structure is electrically connected to the cathode electrode 104. The second end of the carbon nanotube linear structure includes a plurality of taper-shape structures, as shown in FIGS. 7 and 8. The plurality of taper-shape structures includes a plurality of carbon nanotubes oriented substantially along an axial direction of the taper-shape structures. The carbon nanotubes are substantially parallel to each other, and are combined with each other by van der Waals attractive force.

The plurality of taper-shape structures includes one carbon nanotube close to the narrowest of the through-hole 1100 than the other adjacent carbon nanotubes, and the carbon nanotube can emit more electrons. The carbon nanotube close to narrowest of the through-hole 1100 than the other adjacent carbon nanotubes is fixed with the other adjacent carbon nanotubes by van der Waals attractive force. Therefore, the carbon nanotube can bear large working voltage. Additionally, there can be a gap between tops of the two adjacent taper-shape structures. That can prevent the shield effect caused by the adjacent taper-shape structures.

An envelope curve of the second end of the carbon nanotube linear structure is consistent with the shape of the sidewall of the through-hole 1100. A shortest distance between one end of the carbon nanotube linear structure away from the cathode electrode 104 and the sidewall of the through-hole 1100 is substantially equal. A shortest distance between the tops of the taper-shape structures and the sidewall of the through-hole 1100 is substantially equal, wherein the shortest distance can be in a range from about 5 micrometers to about 300 micrometers. In one embodiment, the shortest distances between the tops of the taper-shape structures and the sidewall of the through-hole 1100 are equal. In one embodiment, the shortest perpendicular distances between the tops of the taper-shape structures and the sidewall of the through-hole 1100 are approximately equal. A difference between the shortest distances between the tops of the taper-shape structures and the sidewall of the through-hole 1100 can be in a range from about 0 micrometers to about 100 micrometers.

Figure 9:
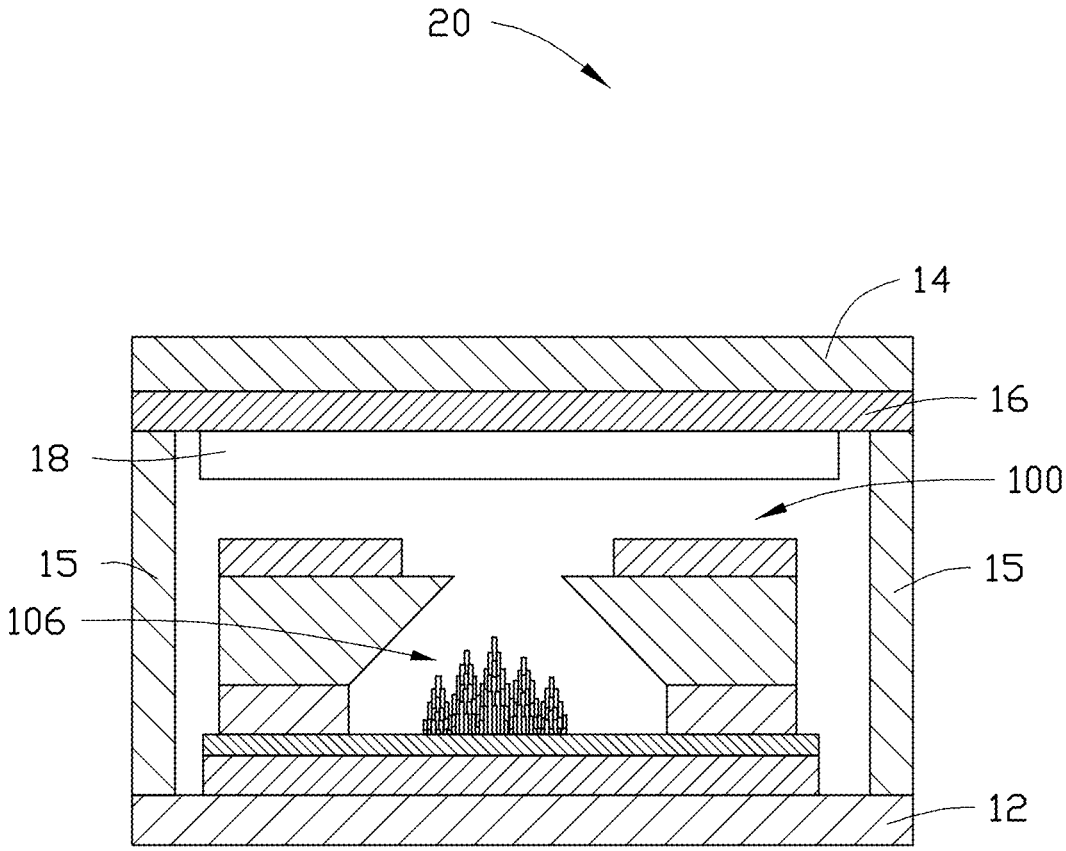
FIG. 9 is a schematic view of another embodiment of a pixel unit of a field emission display.

Referring to FIG. 9, an embodiment of a field emission display 20 is shown where the electron emitter 106 is the carbon nanotube linear structure including the plurality of carbon nanotubes.

Figure 10:
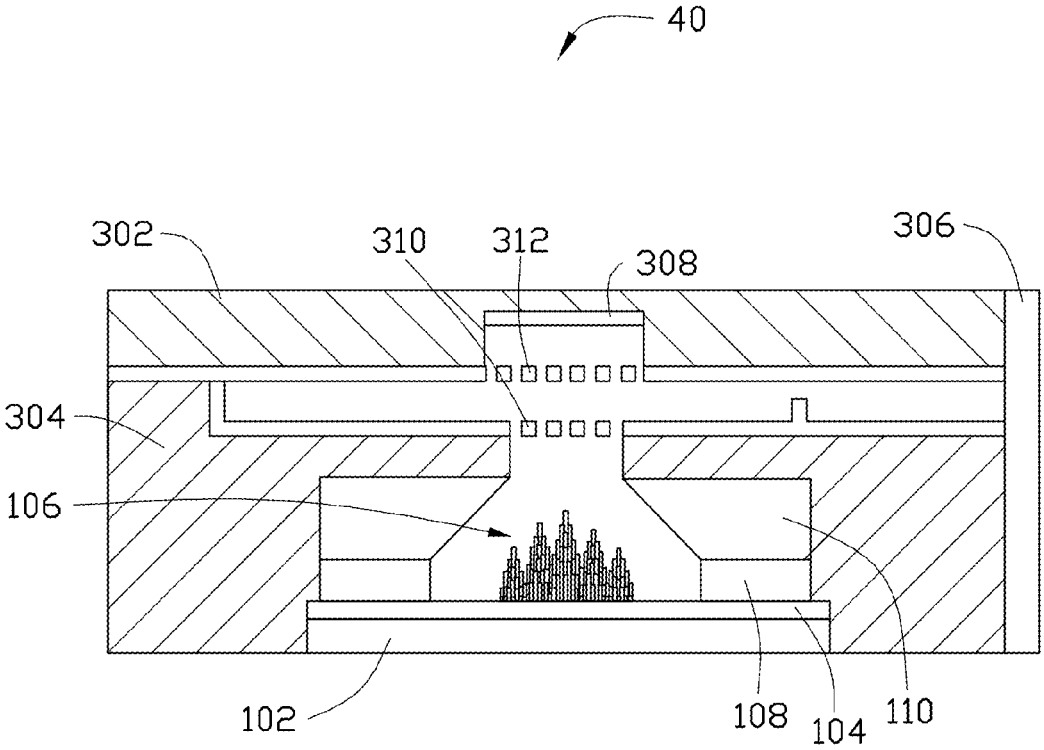
FIG. 10 is a schematic view of another embodiment of a THz electromagnetic tube.

Referring to FIG. 10, an embodiment of a THz electromagnetic tube 40 is shown where the electron emitter 106 is the carbon nanotube linear structure including the plurality of carbon nanotubes.

Figure 11:
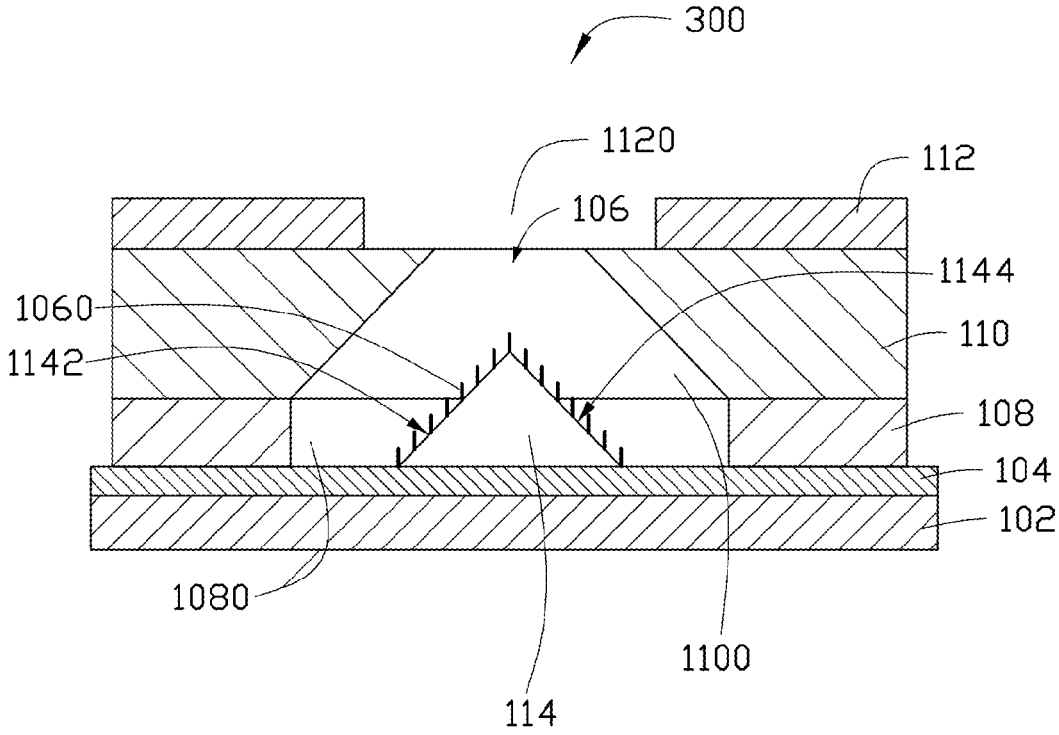
FIG. 11 is a schematic view of yet another embodiment of a field emission cathode device.

Referring to FIG. 11, an embodiment of a field emission cathode device 300 is shown where the electron emitter 106 includes an electric conductor 114 and a plurality of sub-electron emitters 1060. The shape of the electric conductor 114 is a triangle having a first surface 1142, a second surface 1144, and a third surface. The third surface of the electric conductor 114 is electrically connected to the cathode electrode 104. The plurality of sub-electron emitters 1060 is located on the first surface 1142 and the second surface 1144. The plurality of sub-electron emitters 1060 is electrically connected to the first surface 1142 and the second surface 1144. The electric conductor 114 can be made of conducting material, such as metal, conducting polymer.

Figure 12:
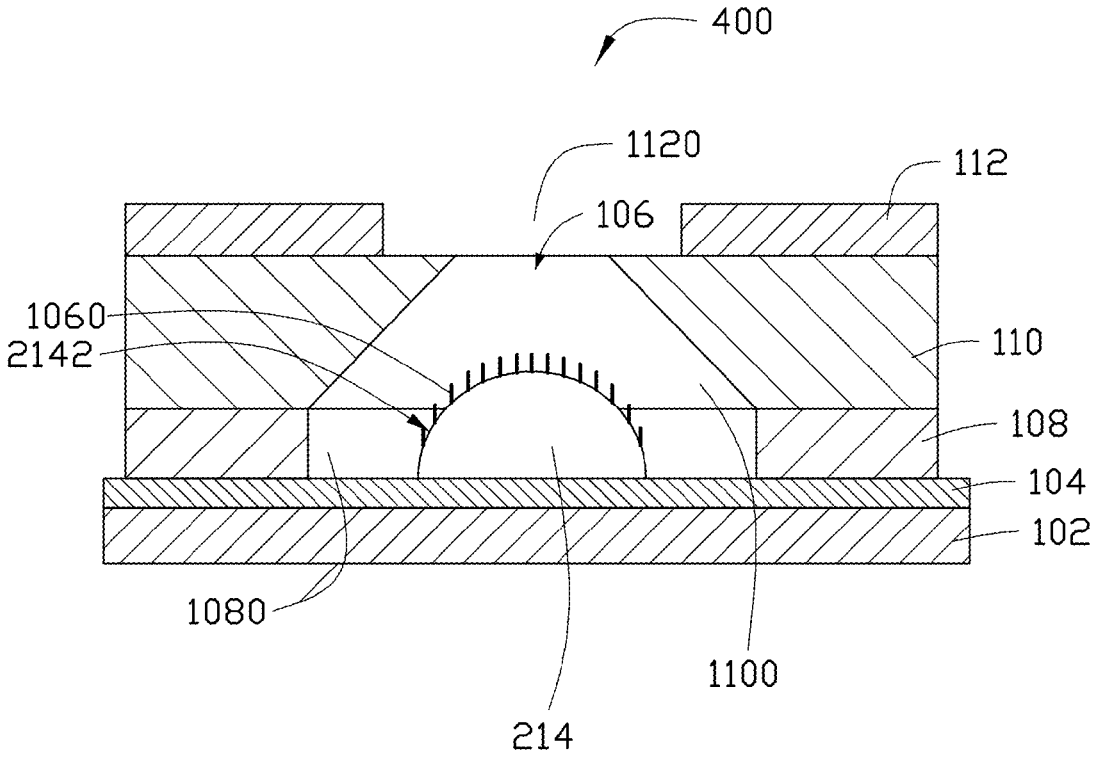
FIG. 12 is a schematic view of yet another embodiment of a field emission cathode device.

Referring to FIG. 12, an embodiment of a field emission cathode device 400 is shown where the electron emitter 106 includes an electric conductor 214 and a plurality of sub-electron emitters 1060. The shape of the electric conductor 214 is a hemisphere having a fourth surface 2142 and a fifth surface. The fourth surface 2142 is an arc winding to the cathode electrode 104. The plurality of sub-electron emitters 1060 is located on the fourth surface 2142 and electrically connected to the fourth surface 2142. The shape of the fifth surface is plane. The fifth surface is electrically connected to the cathode electrode 104. The electric conductor 214 can be made of conducting material, such as metal, conducting polymer. The plurality of sub-electron emitters 1060 can have equal lengths.

It is to be understood the shape of the electric conductors 114 or 214 is consistent with the shape of the sidewall of the through-hole 1100.

In summary, the shortest distance between each of the plurality of sub-electron emitters 1060 and the sidewall of the through-hole 1100 is substantially equal, such that the electric field of each of the plurality of sub-electron emitters 1060 is substantially equal, improving the emission current destiny of the electron emitter 106. Furthermore, the electron emitter 106 has a height gradually reducing from a center of the electron emitter 106 out, or is a carbon nanotube linear structure including at least one taper-shape structure. Therefore, the shield effect caused by adjacent sub-electron emitters 1060 can be prevented, improving the emission current destiny of the electron emitter 106. Moreover, the through-hole 1100 of the electron extracting electrode 110 is shaped as an inverted funnel such that the width thereof is narrowed away from the insulating substrate 102. That can focus the electron beam extracted from the electron emitter 106, further improving the emission current destiny of the electron emitter 106.

It is to be understood that the above-described embodiment is intended to illustrate rather than limit the disclosure. Variations may be made to the embodiment without departing from the spirit of the disclosure as claimed. The above-described embodiments are intended to illustrate the scope of the disclosure and not restricted to the scope of the disclosure.

It is also to be understood that the above description and the claims drawn to a method may include some indication in reference to certain steps. However, the indication used is only to be viewed for identification purposes and not as a suggestion as to an order for the steps.

What is claimed is:

1. A field emission cathode device, comprising:

a cathode electrode having a planar surface;

an electron emitter located on the planar surface of the cathode electrode and electrically connected to the cathode electrode, wherein the electron emitter comprises a plurality of sub-electron emitters, a height of the electron emitter gradually reduces from a center of the electron emitter out to each of edge of the electron emitter; and a connecting line of the end of each of the plurality of sub-electron emitters, away from the cathode electrode, is consistent with the shape of the sidewall of the through-hole;

an electron extracting electrode spaced from the cathode electrode by a dielectric layer, wherein the electron extracting electrode defines a through-hole, and a part of the plurality of sub-electron emitters extends to the through-hole;

wherein the distances between an end of each of the plurality of sub-electron emitters away from the cathode electrode and the closest portion of a sidewall of the through-hole are substantially equal.

2. The field emission cathode device of claim 1, wherein the distance is in a range from about 5 micrometers to about 300 micrometers.

3. The field emission cathode device of claim 1, wherein the through-hole is shaped as an inverted funnel such that the width thereof is narrowed as it goes apart from the cathode electrode.

4. The field emission cathode device of claim 1, wherein a secondary electron emission layer is formed on the sidewall of the through-hole of the electron extracting electrode.

5. The field emission cathode device of claim 1, wherein a height of each of the plurality of sub-electron emitters is greater than a thickness of the dielectric layer.

6. The field emission cathode device of claim 1, wherein the electron emitter is a carbon nanotube array comprising a plurality of carbon nanotubes substantially parallel to each other, and the plurality of sub-electron emitters is the plurality of carbon nanotubes.

7. The field emission cathode device of claim 6, wherein each of the plurality of carbon nanotubes extends towards the through-hole of the electron extracting electrode.

8. The field emission cathode device of claim 1, wherein the plurality of sub-electron emitters are carbon nanotubes, carbon nanofibres, or silicon nanowires.

9. The field emission cathode device of claim 1, wherein the electron emitter is a carbon nanotube linear structure comprising a plurality of carbon nanotubes, and each of the plurality of carbon nanotubes functions as each of the plurality of sub-electron emitters, and one end of the carbon nanotube linear structure away from the cathode electrode comprises a plurality of taper-shape structures.

10. The field emission cathode device of claim 9, the through-hole comprises a first opening and a second opening opposite to the first opening, and the plurality of taper-shape structures comprises one carbon nanotube which is closer to the first opening of the through-hole than other adjacent carbon nanotubes, wherein an area of the first opening is less than an area of the second opening.

11. The field emission cathode device of claim 10, the one carbon nanotube closest to the first opening of the through-hole is fixed with the other adjacent carbon nanotubes by van der Waals attractive force.

12. The field emission cathode device of claim 1, further comprising a fixing element located on a surface of the electron extracting electrode.

13. The field emission cathode device of claim 1, wherein the electron emitter comprises an electric conductor having a shape consistent with the shape of the sidewall of the through-hole.

14. A field emission equipment, comprising:

a cathode electrode having a planar surface;

an electron emitter located on the planar surface of the cathode electrode and electrically connected to the cathode electrode, wherein the electron emitter comprises a plurality of sub-electron emitters, a height of the electron emitter gradually reduces from a center of the electron emitter out to each of edge of the electron emitter; and a connecting line of the end of each of the plurality of sub-electron emitters, away from the cathode electrode, is consistent with the shape of the sidewall of the through-hole;

an electron extracting electrode spaced from the cathode electrode by a dielectric layer, wherein the electron extracting electrode defines a through-hole, and a part of the plurality of sub-electron emitters extends to the through-hole, a connecting line of an end of each of the plurality of sub-electron emitters away from the cathode electrode is consistent with the shape of a sidewall of the through-hole; and an anode electrode having a fluorescent layer located on a surface of the anode electrode, wherein the electron extracting electrode is located between the cathode electrode and the anode electrode.

15. The field emission cathode device of claim 14, wherein the through-hole is shaped as an inverted funnel such that the width thereof narrows away from the cathode electrode.

16. The field emission cathode device of claim 14, wherein a distance between the end of each of the plurality of sub-electron emitters away from the cathode electrode and the sidewall of the through-hole is in a range from about 5 micrometers to about 300 micrometers.

17. A field emission equipment, comprising:

a cathode electrode having a planar surface;

an electron emitter located on the planar surface of the cathode electrode and electrically connected to the cathode electrode, wherein the electron emitter comprises a plurality of sub-electron emitters, a height of the electron emitter gradually reduces from a center of the electron emitter out to each of edge of the electron emitter; and a connecting line of the end of each of the plurality of sub-electron emitters, away from the cathode electrode, is consistent with the shape of the sidewall of the through-hole;

an electron extracting electrode spaced from the cathode electrode by a dielectric layer, wherein the electron extracting electrode defines a through-hole, and a part of the plurality of sub-electron emitters extends to the through-hole, distances between an end of each of the plurality of sub-electron emitters away from the cathode electrode and the closest portion of a sidewall of the through-hole are substantially equal;

a first substrate and a second substrate formed a resonator; and a lens located on one end of the resonator to form an output terminal, wherein electrons extracted from the electron emitter are oscillated in the resonator and exported through the output terminal.

18. The field emission cathode device of claim 17, wherein the electron emitter is a carbon nanotube array comprising a plurality of carbon nanotubes substantially parallel to each other, and the plurality of sub-electron emitters is the plurality of carbon nanotubes.

* * * * *